US007367142B2

(12) United States Patent
Ferniani et al.

(10) Patent No.: US 7,367,142 B2
(45) Date of Patent: May 6, 2008

(54) OPEN SHOE, SUCH AS A SLIPPER, SANDAL AND THE LIKE

(75) Inventors: Aldo Ferniani, Padua (IT); Stefano Ferniani, Padua (IT)

(73) Assignee: Exo Italia S.R.L., Padua (IT)

( * ) Notice: Subject to any disclaimer, the term of this patent is extended or adjusted under 35 U.S.C. 154(b) by 347 days.

(21) Appl. No.: 11/124,048

(22) Filed: May 9, 2005

(65) Prior Publication Data

US 2005/0262726 A1 Dec. 1, 2005

(30) Foreign Application Priority Data

May 28, 2004 (IT) ..... PD20040044 U

(51) Int. Cl.
*A43B 3/12* (2006.01)

(52) U.S. Cl. ..... 36/11.5; 36/100; 36/8.1

(58) Field of Classification Search ..... 36/11.5, 36/100, 101, 43, 8.1
See application file for complete search history.

(56) References Cited

U.S. PATENT DOCUMENTS 3,599,353 A * 8/1971 Magidson ..... 36/11.5
4,525,940 A * 7/1985 Mochizuki ..... 36/8.1
5,060,400 A 10/1991 Finn et al.
6,003,246 A * 12/1999 Pan ..... 36/11.5
2005/0132616 A1* 6/2005 Yu ..... 36/100

FOREIGN PATENT DOCUMENTS

| | | |
|---|---|---|
| DE | 81 01 424 U1 | 6/1981 |
| FR | 1 377 513 A | 11/1964 |
| GB | 2 344 271 A | 6/2000 |
| WO | WO 2004/026062 A | 4/2004 |

* cited by examiner

*Primary Examiner*—Marie Patterson
(74) *Attorney, Agent, or Firm*—Faegre & Benson, LLP

(57) ABSTRACT

An open shoe, such as a slipper, sandal and the like, comprising a sole with which an insole and an upper are associated. The insole has part of its edges engaged in a corresponding recess, which is provided as an undercut on the upper perimetric side wall of the sole and is formed by an inward rim, which is perimetric and has, for each side of the sole, a discontinuity for guiding insertion of the edges of the insole in the inward lip. The discontinuities are located at at least part of the regions of the side wall where the upper connects.

6 Claims, 4 Drawing Sheets

OPEN SHOE, SUCH AS A SLIPPER, SANDAL AND THE LIKE

The present invention relates to an open shoe, such as a slipper, sandal and the like.

BACKGROUND OF THE INVENTION

Open shoes are currently very widely used which are substantially constituted by an upper made of plastics, leather or fabric, by an insole generally made of EVA (ethyl vinyl acetate) and by a sole with a tread, also made of a plastic material that is slightly more rigid than the insole, generally made of injected expanded EVA.

As mentioned, the insoles are generally made of EVA, which ensures high standards of softness and strength and further allows to avoid absorbing water in the case of beach-type slippers or sandals.

After its production, the insole must be coupled to the previously formed sole.

Currently, the only method used to couple the insole to the sole is the interposition of adhesive between them.

The process for adhesive bonding of the insole to the sole is extremely complex and difficult.

In the case of a sole made of EVA, for example, the two components are washed with solvents, a primer is applied, irradiation with UV rays is performed in order to activate the primer, and adhesives are applied to the two parts; this is followed by reviving in an oven and finally by coupling with subsequent pressing.

The upper can be manufactured separately and fixed during the adhesive bonding of the insole and the sole, optionally inserting its lateral edges between said insole and the sole or by gluing said lateral edges to the sides of the sole; generally, with this procedure the outer side of the insole is exposed and must therefore ensure an aesthetic finish.

Another system for fixing the upper to the sole is of the mechanical type and uses mushroom-shaped tabs, which protrude from the edges of said upper and are inserted in appropriately provided undercut slots formed in the sole; in this case, the insole is glued inside a tray, which is shaped complementarily to said insole, and accordingly the outer side of the insole does not remain exposed.

It can be noticed that these manufacturing systems for open shoes have aspects that can be improved.

First of all, it is evident that the method for adhesive bonding of the insole to the sole is extremely laborious, long and expensive.

This is even more true for materials such as EVA, which require particular care during adhesive bonding steps.

Secondly, the coupling between the insole and the sole that is provided by means of adhesive is easily affected by external agents, which therefore can reduce it.

Moreover, the materials of said shoes are difficult to recycle, since it is particularly difficult to separate the insole from the sole, which are typically made of different materials that are often not compatible during recycling.

International Application WO2004/026062 discloses an improvement of the above described additional fixing system, in which the mushroom-shaped tabs that protrude from the edges of the upper pass through corresponding passages provided in the insole and engage the corresponding undercut slots in the sole.

This improvement allows to avoid gluing the insole to the sole and also locks said insole mechanically.

SUMMARY OF THE INVENTION

The aim of the present invention is to provide an open shoe, such as a slipper, sandal and the like, that solves the problems highlighted in known types of open shoe.

Within this aim, an object of the present invention is to provide an open shoe that reduces and facilitates the operations for assembling the various parts of the shoe.

In particular, another object of the present invention is to provide an open shoe that eliminates adhesive bonding between the insole and the sole.

Another object of the present invention is to provide an open shoe that allows to recycle at least part of the shoe once it has been discarded.

Another object of the present invention is to provide an open shoe, such as a slipper, sandal and the like, that can be manufactured cheaply with known systems and technologies.

This aim and these and other objects that will become better apparent hereinafter are achieved by an open shoe, such as a slipper, sandal and the like, which comprises a sole with which an insole and an upper are associated, characterized in that said insole has part of its edges engaged in a corresponding recess, which is provided as an undercut on the upper perimetric side wall of said sole and is formed by an inward rim, which is likewise perimetric and has, for each side of the sole, a discontinuity for guiding the insertion of said edges of the insole in said recess.

BRIEF DESCRIPTION OF THE DRAWINGS

Further characteristics and advantages of the invention will become better apparent from the description of a preferred but not exclusive embodiment thereof, illustrated by way of non-limiting example in the accompanying drawings, wherein.

DESCRIPTION OF THE PREFERRED EMBODIMENTS

Figure 1:
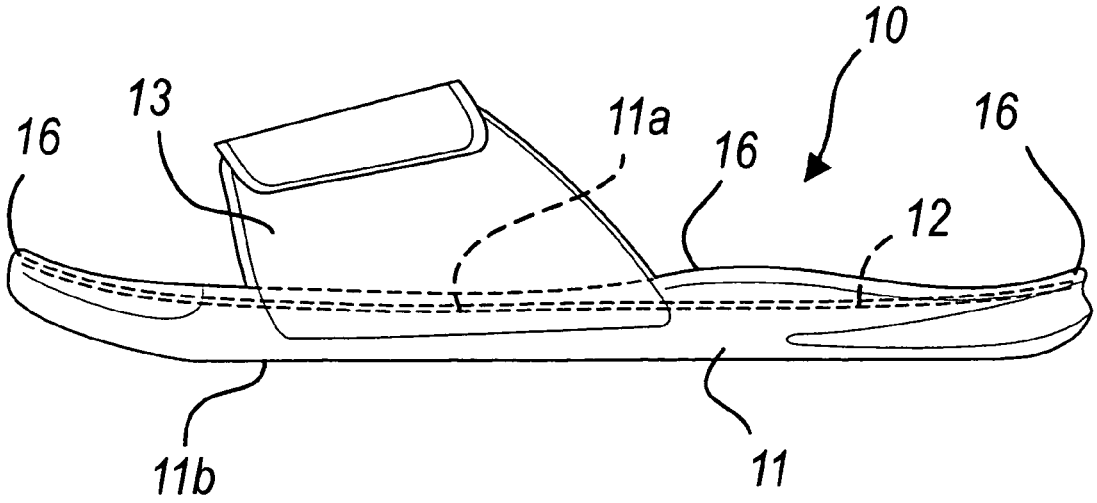
FIG. 1 is a side view of an open shoe according to the invention.
Figure 2:
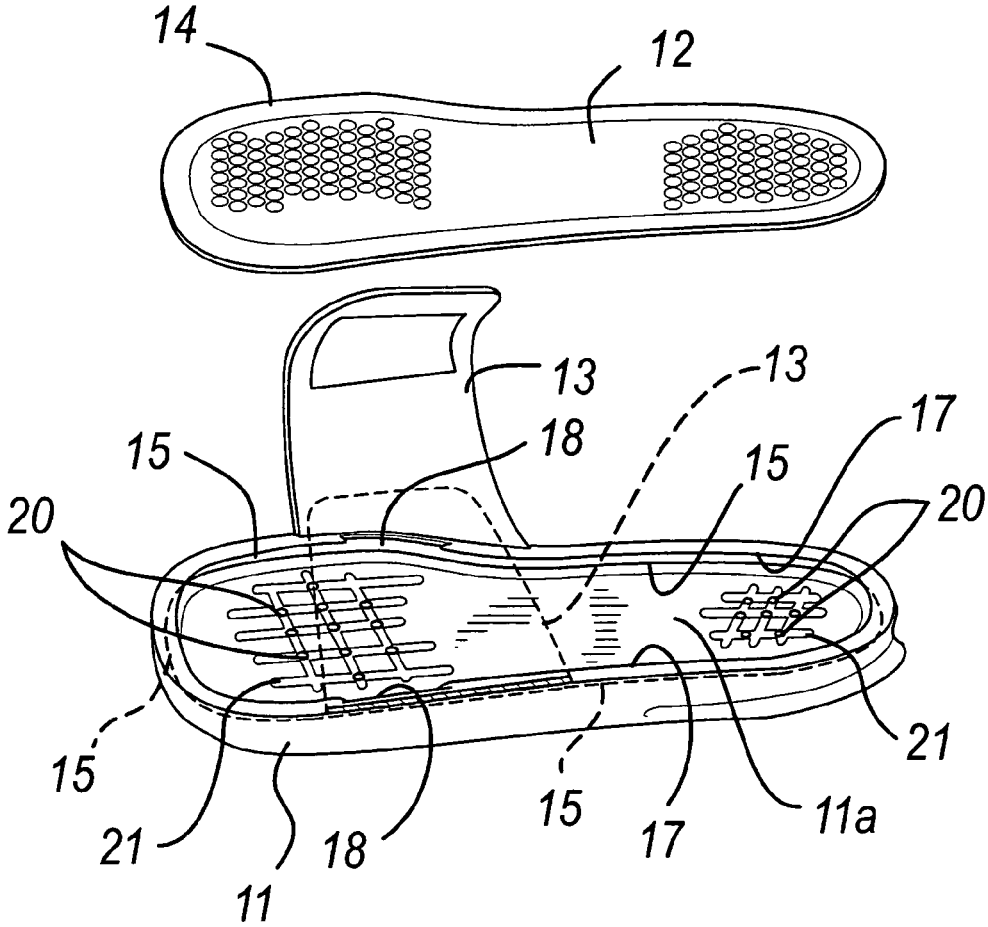
FIG. 2 is an exploded perspective view of an open shoe according to the invention.
Figure 3:
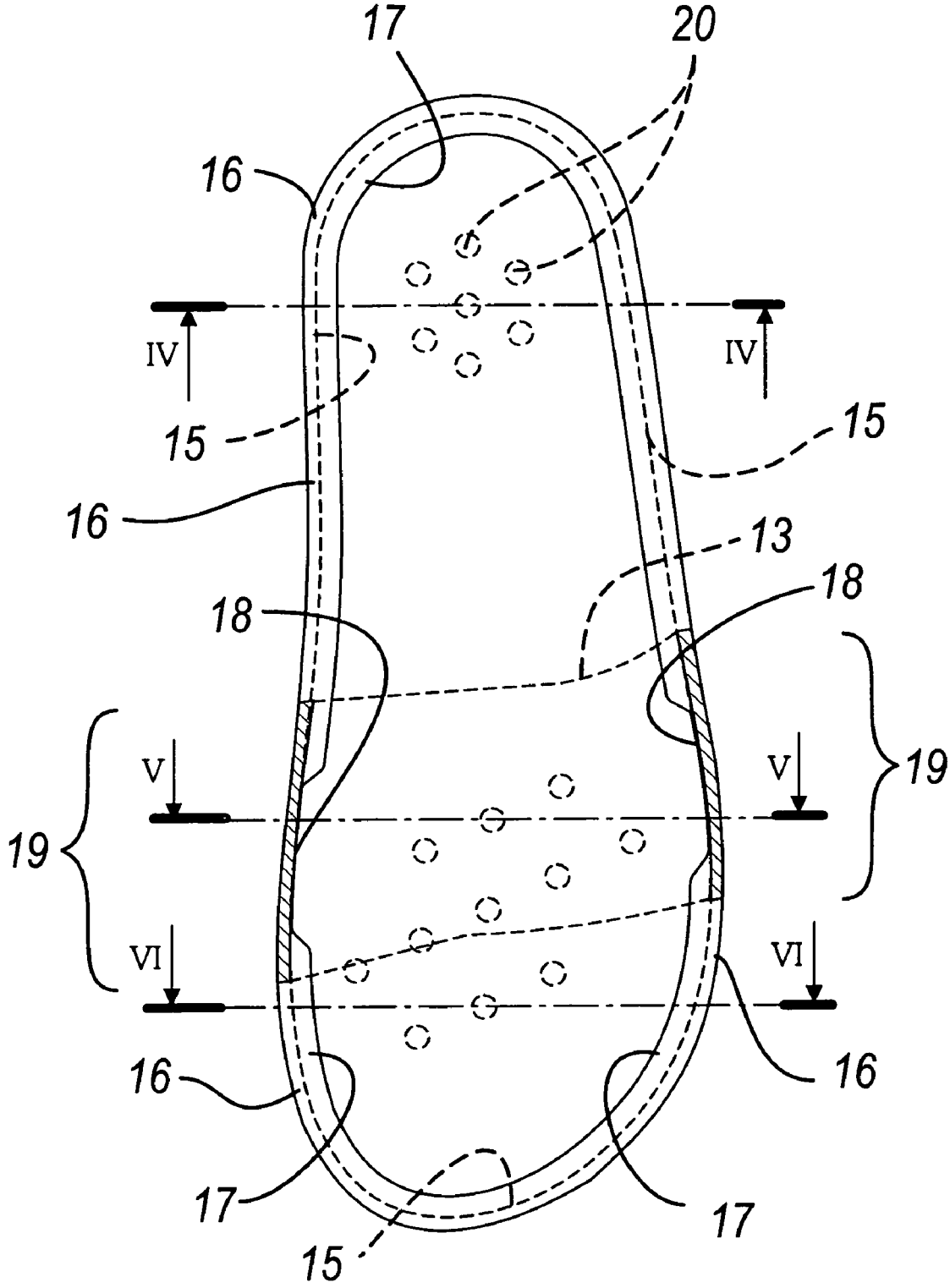
FIG. 3 is a partially sectional top view of an open shoe according to the invention.
Figure 4:
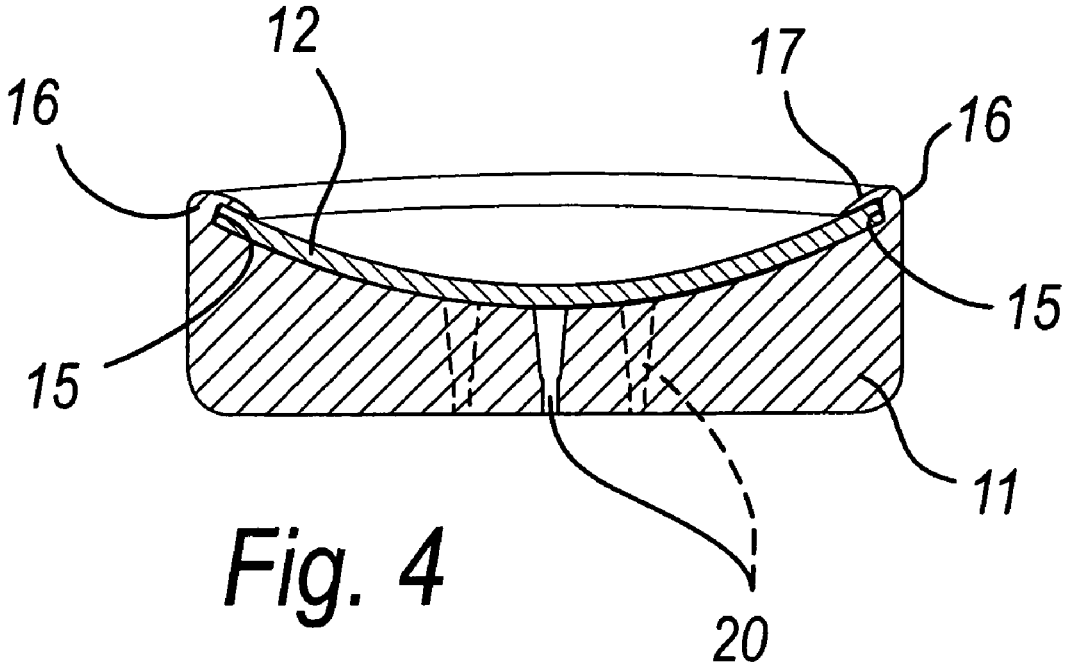
FIG. 4 is a first sectional view of a shoe according to the invention, taken along the line IV-IV of FIG. 3.
Figure 5:
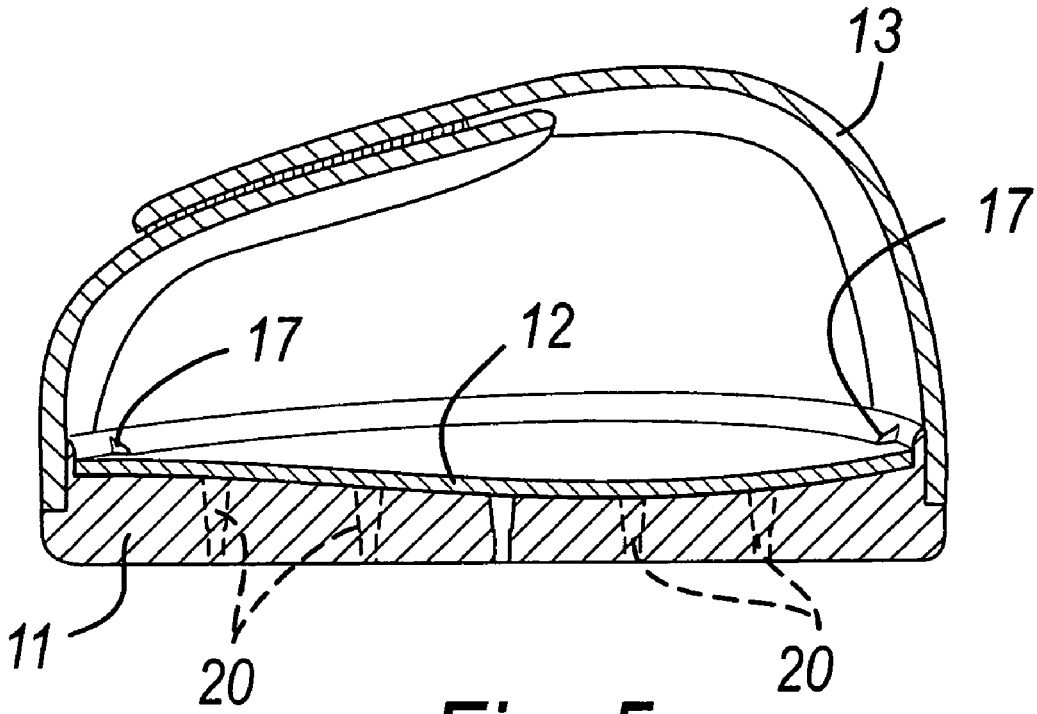
FIG. 5 is a second sectional view of a shoe according to the invention, taken along the line V-V of FIG. 3.
Figure 6:
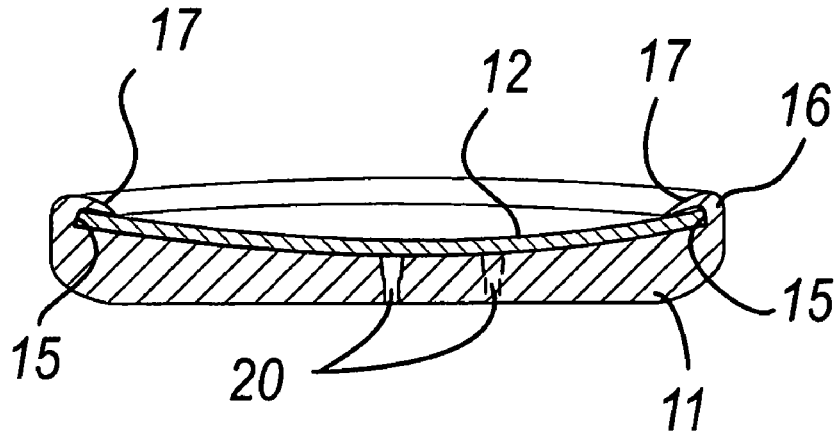
FIG. 6 is a sectional view of a shoe according to the invention, taken along the line VI-VI of FIG. 3.

With reference to the figures, an open shoe, such as a slipper, sandal and the like, according to the invention, is generally designated by the reference numeral 10.

The shoe 10 comprises a sole 11, with which an insole 12 and an upper 13 are associated.

Part of the edges 14 of the insole 12 are engaged in a corresponding inward lip 15.

The inward lip or recess 15 is formed as an undercut on the upper perimetric side wall 16 of the sole 11 and is formed by an inward rim 17, which is likewise perimetric.

The rim 17 is large enough to prevent, during the use of a shoe 10 according to invention, the edges 14 of the insole 12 from escaping from the inward lip 15.

To facilitate the insertion of the edges 14 in the inward lip or recess 15, the rim 17 has a discontinuity 18 for each side of the sole 11.

The discontinuity 18 acts as a guide for the insertion of the edges 14 of the insole 12 in the inward lip 15.

The discontinuity 18 therefore facilitates this insertion, which is otherwise very difficult due to said particular size of the rim 17.

The discontinuity 18 in fact forms, on the upper face 11*a* of the sole 11, therefore the face that lies opposite the tread 11*b*, a sliding surface on which one end (tip or heel) of the insole 12 can be rested flat, i.e., without longitudinal flexing.

Said flat configuration of the end of the insole 12 allows the edges 14 to be inserted in the inward lip or recess 15, thus sliding below the rim 17 and not interfering with it.

Once one end of the insole 12 has been inserted, the insole 12 is flexed transversely until the opposite end, which is still free, rests on said sliding surface, so that said opposite end is likewise inserted in the corresponding inward lip portion or recess 15 without interfering with the rim 17.

The discontinuities 18 are arranged at or along part of the regions 19 of the side wall 16 that are affected by, or where the upper 13 connects to the sole.

In this position, the discontinuities 18 are not visible.

The sole 11 or the insole 12 or both are provided with a plurality of water draining holes 20.

In the embodiment of the invention described here, it is the sole that bears the draining holes 20.

Accordingly, the water that penetrates between the foot of a user and the insole 12 can flow below the insole 12 through the inward lip 15 and be conveyed through the channels 21 to the holes 20 and be evacuated from there.

The upper 13 is fixed to the sole 11 by adhesive bonding or equivalent fixing means (sewing, thermal bonding and the like).

Figure 7:
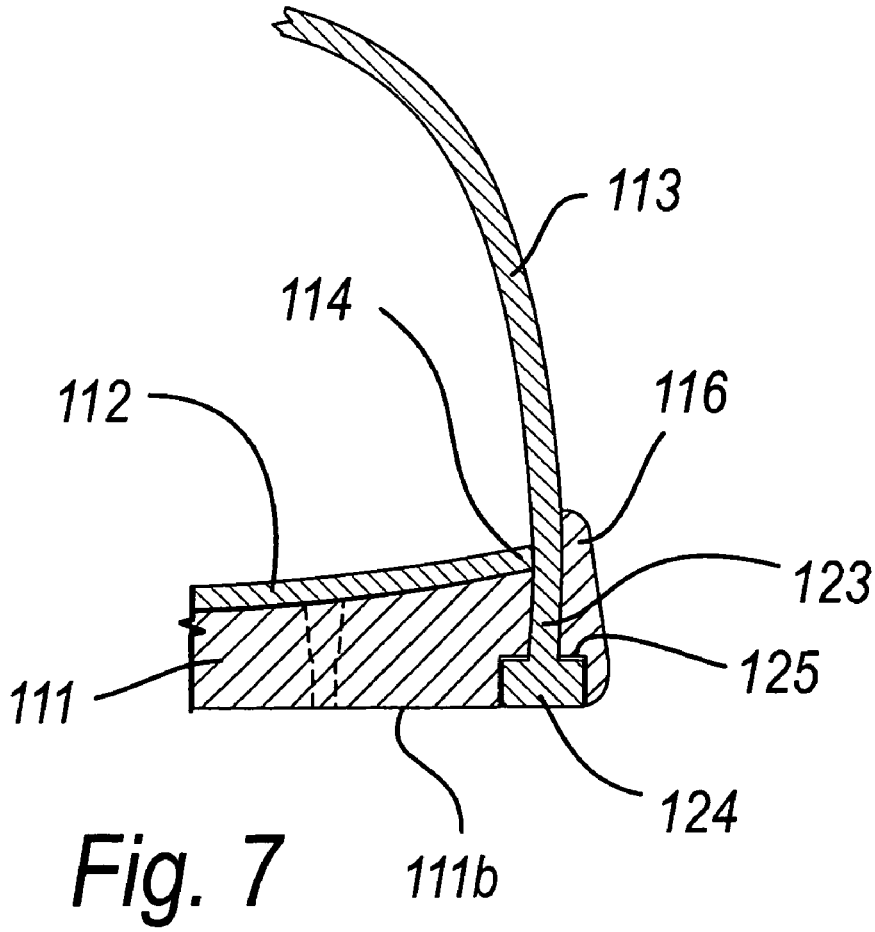
FIG. 7 is a view of another embodiment of a detail of a shoe according to the invention.

In a different embodiment, shown in FIG. 7, the upper 113 is separate from the sole 111 and is connected to it by way of mushroom-shaped protrusions 123, which pass through the sole 111 next to its side wall 116.

The head 124 of the tabs 123 is arranged in a corresponding complementarily shaped seat 125 provided on the tread 111*b* of the sole 111.

The insole 112 is not crossed by the tab 123, which passes between the edge 114 of the insole 112 and the side wall 116.

The sole 11 and the insole 12 are obtained by molding plastic material.

The insole 12 can be die-cut from a sheet instead of being molded.

The sole 11 and the insole 12 can both be made of EVA, but of different densities, so that the insole 12 is softer and the sole 11 is more rigid.

The insole 12 can also be made of other materials, such as leather, hide, rubber or others, and provided in different colors.

A same insole can have its two faces provided in different colors, since by overturning the right and left insoles and transferring them from one sole to the other they can be installed on said soles.

Therefore, an open shoe 10 according to the invention allows great interchangeability for the insole 12, so that the shoe can be adapted well both aesthetically and ergonomically to the requirements of the user.

Further, the insole manufacturing process can use a lateral finish of the insole that is even of lower quality than known insoles, in which the edges must be exposed, since the edges 14 of the insole 12 for a shoe 10 according to the invention are hidden in the inward lip or recess 15 or by the upper 13.

Therefore, this method has lower costs than required for finishes of a higher qualitative level.

In practice it has been found that the invention thus described solves the problems noted above in known types of open shoe.

In particular, the present invention provides an open shoe in which the assembly operations are reduced substantially to one, i.e., the assembly of the insole to the sole.

Moreover, the present invention has provided an open shoe in which the operation for mutually gluing the insole and the sole has been eliminated.

The insole is in fact connected to the sole as described, by inserting the edges of the insole in the corresponding inward lip of the sole, without this being followed by sewing operations or other equivalent fixing operations.

Further, the present invention provides an open shoe that allows to recycle at least part of the shoe once it has been discarded.

If the upper has mushroom-shaped tabs that are suitable for interlocking with the sole, the shoe can be recycled completely in all of its components.

The insole is in fact easy to insert in the sole and equally easy to remove.

This easy separation of the two parts allows to optimize the recycling of the shoe, all the more so if the materials of which the insole and the sole are made are very different.

Moreover, the present invention has provided an open shoe such as a slipper, sandal and the like that can be manufactured cheaply with known systems and technologies.

In practice, the materials used, so long as they are compatible with the specific use, as well as the dimensions, may be any according to requirements and to the state of the art.

The disclosures in Italian Patent Application No. PD2004U000044 from which this application claims priority are incorporated herein by reference.

What is claimed is:

1. An open shoe, comprising: a sole with which an insole and an upper are associated, said insole having part of its edges engaged in a corresponding recess which is provided as an undercut on the upper perimetric side wall of said sole and is formed by an inward rim, which is likewise perimetric and has, for each side of the sole, a discontinuity for guiding insertion of said edges of the insole in said recess, characterized in that the discontinuities are arranged at or along part of regions of the side wall where the upper connects to the sole so that the discontinuities are not visible when the open shoe is viewed from above.

2. The open shoe of claim 1, wherein said sole is provided with a plurality of water drainage holes.

3. The open shoe of claim 1, wherein said upper is connected to said sole by a bonding means selected from the group consisting of: adhesive bonding, sewing, and thermal bonding.

4. The open shoe of claim 1, comprising tabs with heads, and shaped seats that are open on a tread of said sole, said upper being separate from said sole and connectable thereto by way of said wherein said tabs pass through said sole next to the side wall thereof and are arranged between said side wall and an edge of said insole, said heads of said tabs being adapted to be arranged each in a corresponding complementary said shaped seat.

5. The open shoe of claim 1, wherein said sole and said insole are made of a molded plastic material.

6. The open shoe of claim 1, wherein said insole is provided with a plurality of water drainage holes.

* * * * *